US011460039B2

(12) United States Patent
Fournier et al.

(10) Patent No.: US 11,460,039 B2
(45) Date of Patent: Oct. 4, 2022

(54) IMPELLER-AIR INTAKE INTERFACE FOR A CENTRIFUGAL FAN, AND CENTRIFUGAL FAN THEREWITH

(71) Applicants: Carrier Corporation, Palm Beach Gardens, FL (US); Francette Fournier, Bettant (FR)

(72) Inventors: Francette Fournier, Bettant (FR); Gael Herve, Chambery (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/973,295

(22) PCT Filed: Jun. 11, 2018

(86) PCT No.: PCT/IB2018/000749

§ 371 (c)(1),
(2) Date: Dec. 8, 2020

(87) PCT Pub. No.: WO2019/239174

PCT Pub. Date: Dec. 19, 2019

(65) Prior Publication Data

US 2021/0246905 A1 Aug. 12, 2021

(51) Int. Cl.

| | |
|---|---|
| ***F04D 29/28*** | (2006.01) |
| ***F04D 29/42*** | (2006.01) |
| *F04D 29/16* | (2006.01) |

(52) U.S. Cl.

CPC ..... *F04D 29/281* (2013.01); *F04D 29/4226* (2013.01); *F04D 29/162* (2013.01); *F04D 29/4213* (2013.01); *F05D 2250/51* (2013.01)

(58) Field of Classification Search

CPC ..... F04D 29/281; F04D 29/4213; F04D 29/4226; F05D 2250/51

See application file for complete search history.

(56) References Cited

U.S. PATENT DOCUMENTS

| | | | | |
|---|---|---|---|---|
| 2,778,958 | A | 10/1954 | Hamm et al. | |
| 4,917,572 | A * | 4/1990 | Van Houten | F04D 17/16 415/121.2 |
| 5,577,958 | A | 11/1996 | Kumekawa et al. | |
| 6,209,627 | B1 | 4/2001 | Hasumi | |
| 6,450,765 | B1 * | 9/2002 | Carroll | F04D 29/162 415/172.1 |
| 6,470,699 | B1 | 10/2002 | Okuda et al. | |
| 6,481,237 | B2 | 11/2002 | Kim | |

(Continued)

FOREIGN PATENT DOCUMENTS

| | | | |
|---|---|---|---|
| CN | 1991271 | A | 7/2007 |
| CN | 204402918 | U | 6/2015 |

(Continued)

OTHER PUBLICATIONS

First Chinese Office Action; Chinese Application No. 201880094488.5; dated Oct. 13, 2021; 13 pages.

(Continued)

*Primary Examiner* — Ninh H. Nguyen
(74) *Attorney, Agent, or Firm* — Cantor Colburn LLP

(57) ABSTRACT

An interface of a centrifugal fan includes an inlet shroud of an impeller, an air intake positioned in overlapping arranged with a portion of the inlet shroud, and a clearance defined between the inlet shroud and the air intake. The clearance forms a labyrinth fluid flow path for a leakage air flow.

16 Claims, 9 Drawing Sheets

(56) References Cited

U.S. PATENT DOCUMENTS

| | | | | |
|---|---|---|---|---|
| 6,551,185 | B1 | 4/2003 | Miyake et al. | |
| 6,558,120 | B2 | 5/2003 | Kim et al. | |
| 7,048,499 | B2 | 5/2006 | Mathson et al. | |
| 7,748,954 | B2 * | 7/2010 | Eguchi | F04D 29/282 415/119 |
| 7,883,312 | B2 * | 2/2011 | Eguchi | F04D 29/162 415/119 |
| 8,256,241 | B2 | 9/2012 | Ikeda et al. | |
| 2008/0034775 | A1 | 2/2008 | Choi et al. | |
| 2012/0308370 | A1 | 12/2012 | Nagae et al. | |
| 2015/0013945 | A1 | 1/2015 | Choi et al. | |
| 2016/0102871 | A1 | 4/2016 | Yamasari | |
| 2016/0290661 | A1 | 10/2016 | Ogura | |
| 2017/0146248 | A1 | 5/2017 | Yamaguchi | |
| 2017/0307232 | A1 | 10/2017 | Nouchi et al. | |
| 2017/0343235 | A1 | 11/2017 | Nakai et al. | |

FOREIGN PATENT DOCUMENTS

| | | | |
|---|---|---|---|
| CN | 105275884 | A | 1/2016 |
| CN | 205315287 | U | 6/2016 |
| CN | 105736058 | A | 7/2016 |
| EP | 2206988 | A1 | 7/2010 |
| EP | 2000676 | B1 | 12/2017 |
| JP | 2002022210 | A | 1/2002 |
| JP | 2004092583 | A | 3/2004 |
| JP | 2014118949 | A | 6/2014 |
| JP | 2015183941 | A | 10/2015 |
| KR | 20030059893 | A | 7/2003 |
| WO | 9732132 | A1 | 9/1997 |
| WO | 2006106744 | A1 | 10/2006 |
| WO | 2017037556 | A1 | 3/2017 |

OTHER PUBLICATIONS

International Search Report of the Internationa Searching Authority; International Application No. PCT/IB2018/000749; International Filing Date: Jun. 11, 2018; dated Feb. 25, 2019 5 pages.

Written Opinion of the International Searching Authority; International Application No. PCT/IB2018/000749; International Filing Date: Jun. 11, 2018; dated Feb. 25, 2019; 6 pages.

* cited by examiner

IMPELLER-AIR INTAKE INTERFACE FOR A CENTRIFUGAL FAN, AND CENTRIFUGAL FAN THEREWITH

CROSS REFERENCE TO RELATED APPLICATIONS

This application is a National Stage Application of PCT/IB2018/000749, filed Jun. 11, 2018, which is incorporated by reference in its entirety herein.

BACKGROUND

Embodiments of the disclosure relate to a centrifugal fan, and more particularly, to the configuration of the flow path defined between the inlet shroud of an impeller and the inlet bell of an air intake.

Centrifugal fans are typically used in ventilation and air conditioning systems. Examples of common types of ventilation and air conditioning units include, but are not limited to, cassette type ceiling fans, air handling units, and extraction roof fans for example. Air is sucked into the unit and guided by a bell mouth intake into an impeller. A diameter of the bell mouth intake at the interface between the bell mouth intake and the inlet shroud of an impeller is smaller than a diameter of the blower at the interface. Accordingly, a clearance in fluid communication with the blower exists between the exterior of the bell mouth intake and the interior of the blower. A portion of the air output from the blower may recirculate to the impeller through this clearance, thereby reducing the operational efficiency of the fan, and increasing a noise level thereof.

BRIEF DESCRIPTION

According to an embodiment, an interface of a centrifugal fan includes an inlet shroud of an impeller, an air intake positioned in overlapping arranged with a portion of the inlet shroud, and a clearance defined between the inlet shroud and the air intake. The clearance forms a labyrinth fluid flow path for a leakage air flow.

In addition to one or more of the features described above, or as an alternative, in further embodiments the labyrinth fluid flow path has a non-linear configuration.

In addition to one or more of the features described above, or as an alternative, in further embodiments the clearance that forms the labyrinth fluid flow path has at least one turn formed therein.

In addition to one or more of the features described above, or as an alternative, in further embodiments the at least one turn includes at least a 90 degree turn.

In addition to one or more of the features described above, or as an alternative, in further embodiments the at least one turn is at least a 120 degree turn.

In addition to one or more of the features described above, or as an alternative, in further embodiments the at least one turn is about a 180 degree turn.

In addition to one or more of the features described above, or as an alternative, in further embodiments the air intake has a gap formed therein, and a portion of the inlet shroud is positioned within the gap such that the air intake and the inlet shroud axial overlap.

In addition to one or more of the features described above, or as an alternative, in further embodiments the gap is located between a sidewall of the air intake and a portion of a bell mouth curve of the suction intake.

In addition to one or more of the features described above, or as an alternative, in further embodiments the air intake includes an axisymmetric body defined by the sidewall.

In addition to one or more of the features described above, or as an alternative, in further embodiments the inlet shroud further comprises a flange extending from an exterior surface of the inlet shroud.

In addition to one or more of the features described above, or as an alternative, in further embodiments the inlet shroud includes a first portion and a second portion, the first portion having an axial configuration and the second portion having an arcuate configuration.

In addition to one or more of the features described above, or as an alternative, in further embodiments an outlet of the fluid flow path is oriented to direct the leakage flow parallel to a main airflow through the inlet shroud.

According to another embodiment, a fan for use in an air conditioning device includes a centrifugal impeller configured to rotate about an axis of rotation. The centrifugal impeller has a plurality of blades and an inlet shroud mounted at a distal end to the plurality of blades. An air intake is positioned upstream from the impeller relative to a main airflow such that the air intake and the inlet shroud axially overlap. The air intake is contoured to direct the main airflow towards the impeller. A fluid flow path is defined between the impeller and the air intake suction intake, wherein the fluid flow path forms a labyrinth seal.

In addition to one or more of the features described above, or as an alternative, in further embodiments the fluid flow path has a non-linear configuration.

In addition to one or more of the features described above, or as an alternative, in further embodiments the fluid flow path has at least one turn formed therein.

In addition to one or more of the features described above, or as an alternative, in further embodiments the fluid flow path includes at least one about 180 degree turn.

In addition to one or more of the features described above, or as an alternative, in further embodiments an outlet of the fluid flow path is oriented to direct a leakage flow parallel to the main airflow.

In addition to one or more of the features described above, or as an alternative, in further embodiments the air intake has a gap formed therein, and a portion of the inlet shroud is positioned within the gap.

In addition to one or more of the features described above, or as an alternative, in further embodiments the air intake further comprises a sidewall and a bell mouth curve, the gap being defined between the sidewall and a portion of the bell mouth curve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
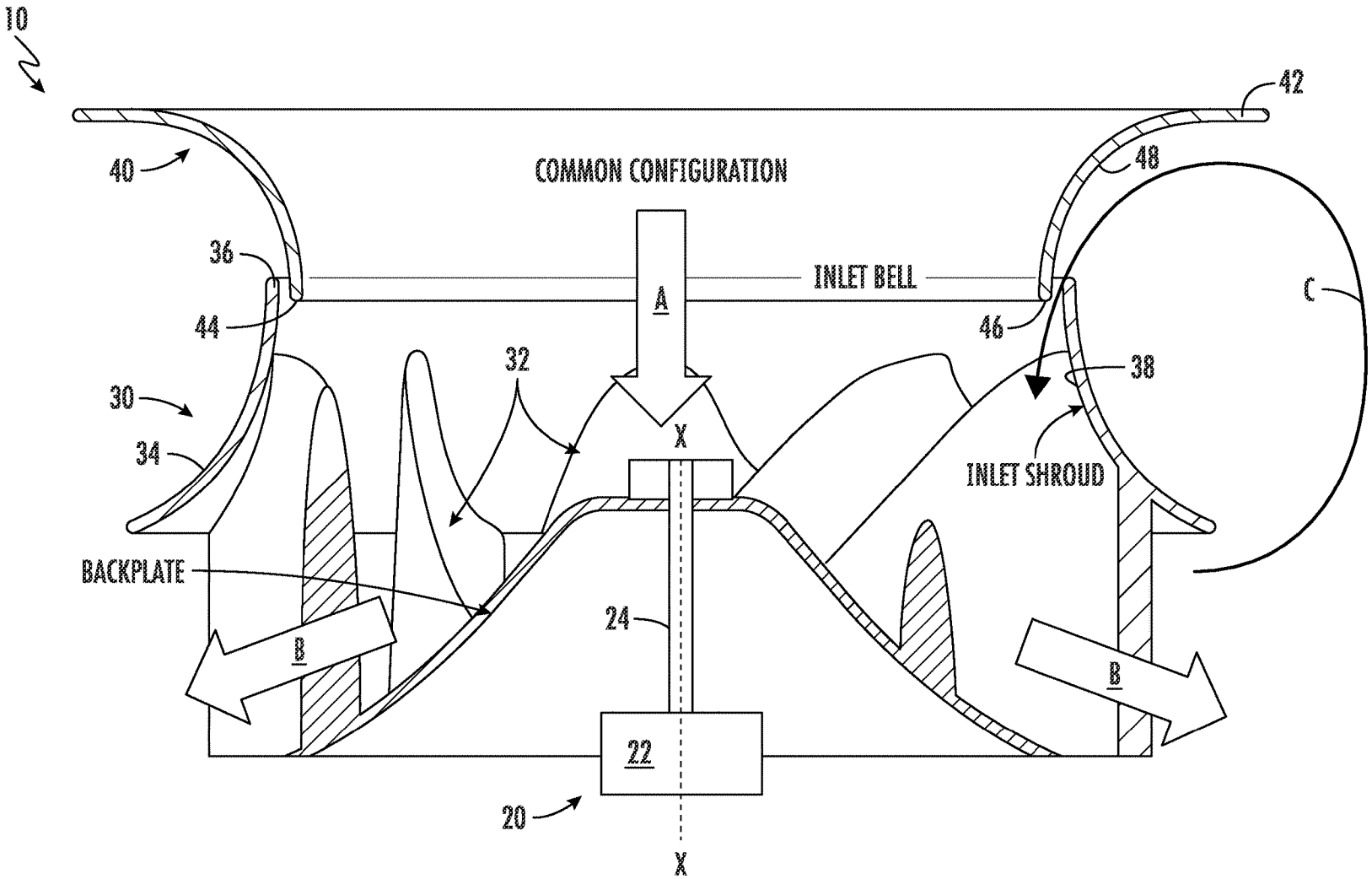
FIG. 1 PRIOR ART
FIG. 1 is a cross-sectional view of an example of an existing centrifugal fan as used in ceiling cassette type air conditioner.

With reference now to FIG. 1, an example of a centrifugal fan 10, such as commonly used in a ceiling cassette type air conditioner for example is illustrated. The centrifugal fan or blower 10 includes a fan motor, illustrated schematically at 20, and an impeller 30. The fan motor 20 includes a motor base 22 and a motor shaft 24 extending from the motor base 22 and configured to rotate about an axis X. The impeller 30 is mounted to the motor shaft 24 for rotation with the shaft 24 about the fan axis X. The impeller 30 includes a plurality of fan blades 32 that are connected at a distal end via an inlet shroud 34.

The centrifugal fan 10 additionally includes an air intake 40. As shown in FIG. 1, the air intake 40 is typically formed with a bell mouth, and is always arranged upstream from the inlet shroud 34 relative to the flow of air A through the centrifugal fan 10. The air intake 40 includes a first end 42 and a second end 44, the second end 44 being substantially coplanar with, or alternatively, slightly overlapping an inlet end 36 of the inlet shroud 34. Further, the air intake 40 has a first diameter at the first end 42 and a second diameter at the second end 44 thereof, the second diameter being substantially smaller than the first diameter, and smaller than the diameter of the inlet shroud 34 at the inlet end 36. To achieve the bell mouth contour, the diameter of the air intake 40 gradually reduces between the first and second ends 42, 44 to achieve a desired curved shaped.

During operation of the centrifugal fan 10, the fan motor 20 is energized, causing the impeller 30 to rotate about the axis X. This rotation sucks air into the impeller 30 via the intake 40, in the direction indicated by arrow A. Within the impeller 30, the axial air flow transitions to a radial air flow and is provided outwardly to an adjacent component, as indicated by arrows B, such as a heat exchanger (not shown) for example.

A clearance 46 exists between the exterior surface 48 of the air intake 40 and the interior surface 38 of the inlet shroud 34 of the impeller 30. As a result, during operation of the centrifugal fan 10, a portion of the air expelled radially outwardly from the impeller 30 recirculates back into the impeller 30 through this clearance. This air flow, indicated by arrow C, sometimes referred to as "leakage flow," reduces the efficiency of the centrifugal fan 10. It is therefore desirable to minimize the leakage flow between the suction intake 40 and the inlet shroud 34 of the impeller 30.

With reference now to FIGS. 2-5, various examples of the clearance 46 formed between the air intake 40 and the inlet shroud 34 of an impeller 30 of a centrifugal fan 10 having a configuration intended to minimize the leakage flow are illustrated. With specific reference to FIG. 2, the internal profile of the inlet shroud 34 is similar to the inlet shroud of existing systems. As shown, the inlet shroud 34 has a generally arcuate contour such that a diameter of the inlet shroud 34 gradually increases in the axial direction of the airflow A. In an embodiment, a secondary flange 50 extends from an exterior surface of the inlet shroud 34 at a generally central portion thereof. As shown, the flange 50 may be oriented substantially parallel to the rotational axis X of the impeller 30. Due to the curvature of the inlet shroud 34, a portion of the inlet shroud 34 extending between the flange 50 and the inlet end 36 may also be oriented generally parallel to the flange 50. As a result, a clearance 52 is defined between the flange 50 and the portion of the inlet shroud 34 extending between the flange 50 and the inlet end 36 of the shroud 34. Accordingly, in an embodiment, the inlet shroud 34 may be considered to have a Y-like shape adjacent the inlet end 36 thereof. The free end 54 of the flange 50 may extend a distance beyond the upstream end 40 of the inlet shroud 34. Further, the free end 54 of the flange 50 and the adjacent end 36 of the inlet shroud 34 may be beveled, such as at an angle towards the central axis X about which the inlet shrouds 34 rotates. This angle may be intended to direct the remaining leakage flow provided to the impeller 30, as close to parallel with the rotational axis X as possible. In an embodiment, the inlet shroud 34 including the flange 50 is formed via a molding process using a composite material.

In existing systems, as shown in FIG. 1, the air intake 40 is defined by a thin piece of material, such as sheet metal for example, contoured to form a bell mouth shape. As shown, in the FIGS. 2A and 2B however, the air intake 40 includes a generally axisymmetric body 60 defined by a linearly extending sidewall 62. A minimum thickness of the sidewall 62 may be determined by the manufacturing process used to form the air intake 40. In an embodiment, the minimum thickness of the sidewall 62 of the suction intake 40 is sized to be compatible for manufacturing using a material such as expanded polystyrene or "PSE." Further, the maximum thickness may be determined by the free space within the centrifugal fan 10. As shown, the air intake 40 additionally includes a curved bell mouth contour 64 to facilitate the flow of air towards the impeller 30. In the illustrated, non-limiting embodiment, the bell mouth contour 64 is integrally formed with the inlet end 66 of the sidewall 62. A distal end 68 of the bell mouth contour 64 is offset from the adjacent surface of the sidewall 62. As a result, a gap 70 is defined between the distal end 68 of the bell mouth contour 64 and the sidewall 62. When the air intake 40 is installed relative to the impeller 30, both the inlet end 36 of the inlet shroud 34 and the distal end 54 of the flange 50 are received within this gap 70 such that the air intake 40 and the inlet shroud 34 axially overlap.

Together the inlet shroud 34 and the air intake 40 cooperate to form a clearance 80 there between. The clearance 80 extends between the exterior and the interior of the fan 10 to define a fluid flow path through which leakage flow may recirculate to the impeller 30. The fluid flow path defined by the clearance 80 is a generally tortuous, non-linear flow path having one or more turns. As a result, the flow path defined by the clearance 80 may function in a manner similar to a labyrinth seal to prevent or restrict air from recirculating through the impeller 30. As shown, the air output radially from the impeller 30 makes a first turn, indicated by arrow C1, to enter the clearance 80 defined between the air intake 40 and the inlet shroud 34. Within the clearance 80, the leakage flow must travel generally parallel to the sidewall 62 of the air intake 40 and the axis of rotation X until reaching distal end 54 of flange 50. The leakage flow is configured to make a second turn, indicated by arrow C2, around the distal end 54 of the flange 50 and the inlet end 36 of the inlet shroud 34 located within the gap 70. This second turn C2 redirects the leakage flow by at least 90 degrees, and in some embodiments, by 120 degrees, by 150 degrees, up to 180 degrees. In an embodiment, the outlet of the fluid flow path adjacent the downstream end 80 of the bell mouth 64 is oriented generally parallel to the main inlet airflow A.

Figure 2A:
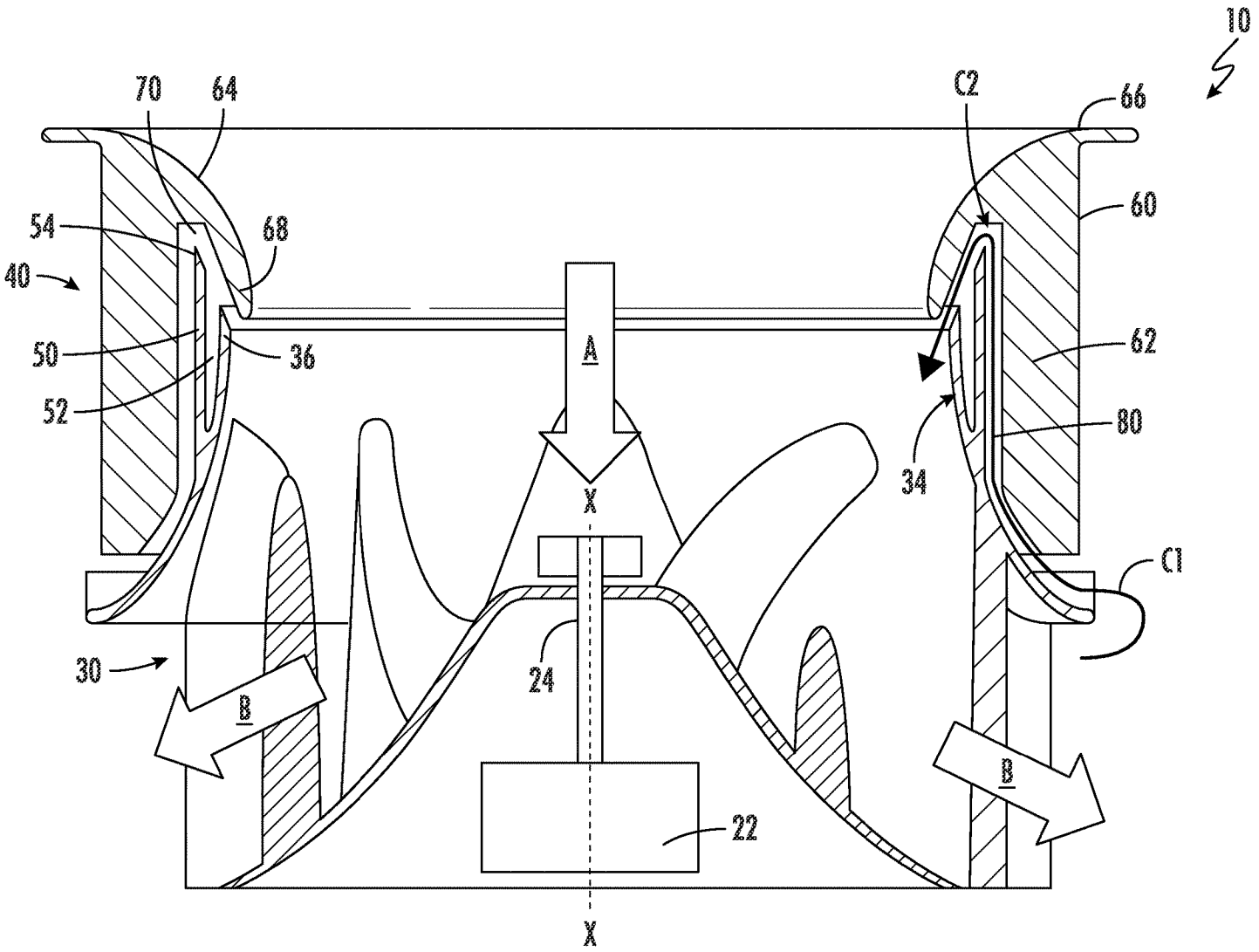
FIG. 2A is a cross-sectional detailed view of an interface between an inlet shroud and an air intake of a centrifugal fan according to an embodiment.
Figure 2B:
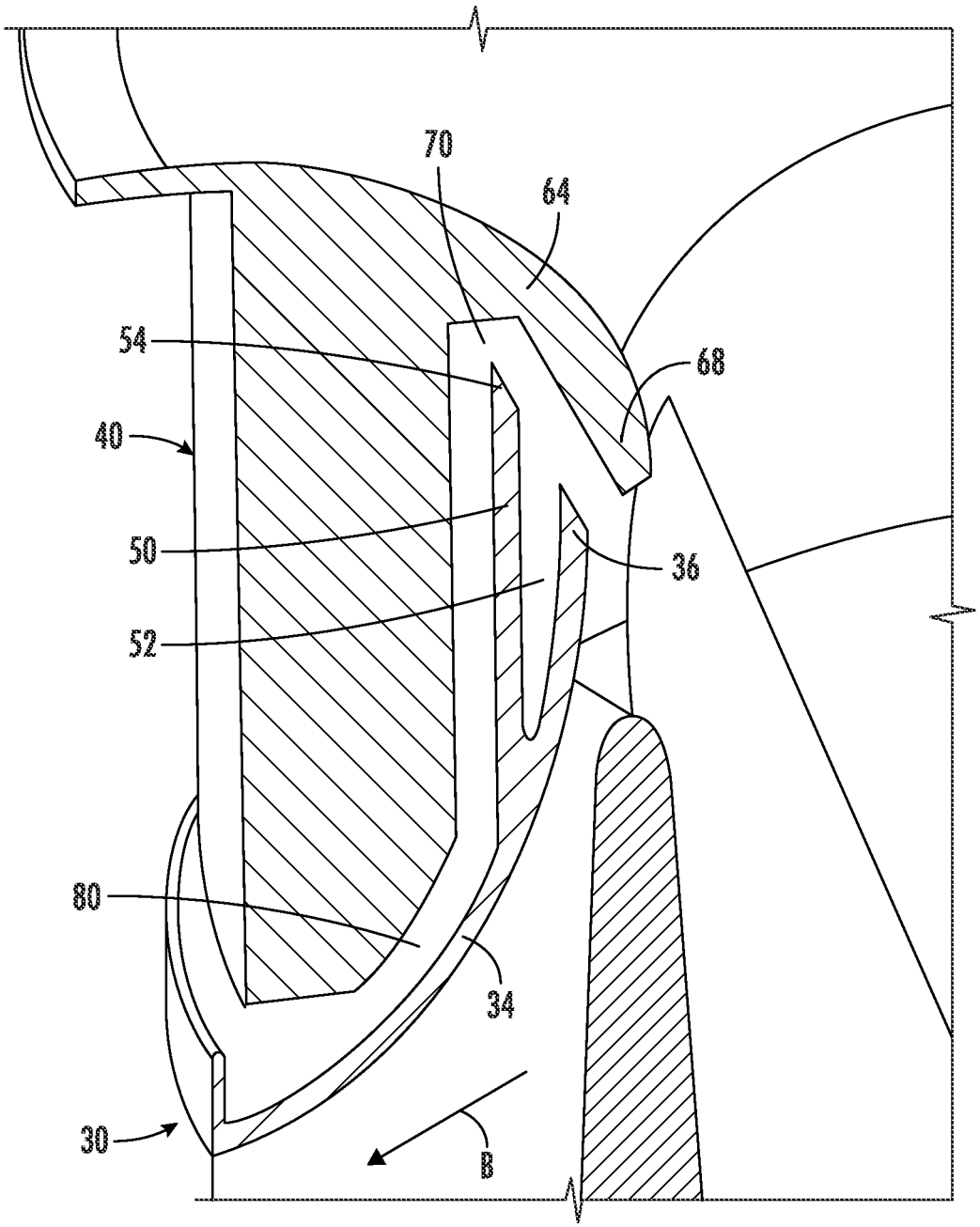
FIG. 2B is a detailed view of the interface between the inlet shroud and the air intake of FIG. 2A according to an embodiment.
Figure 3A:
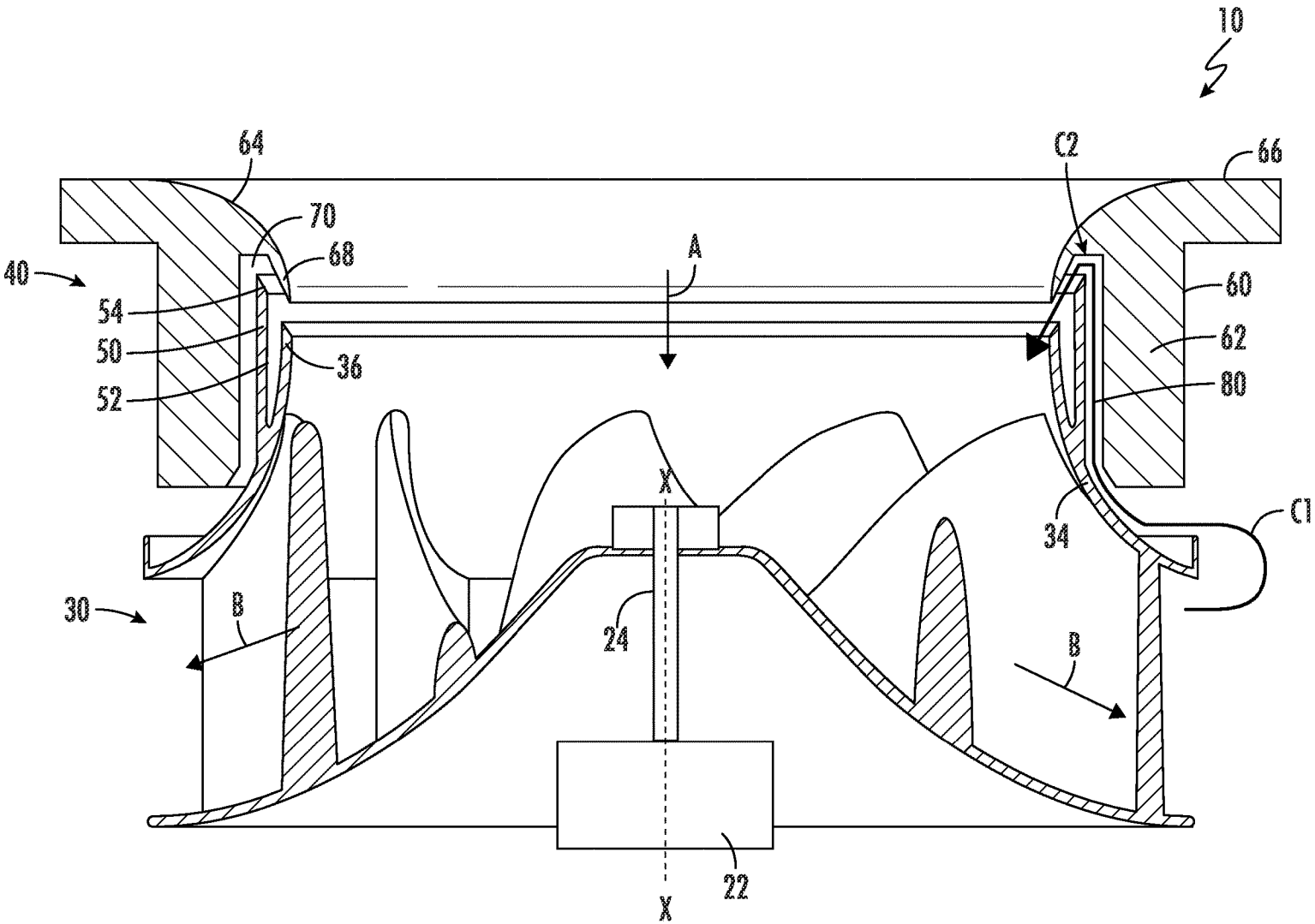
FIG. 3A is a cross-sectional detailed view of an interface between an inlet shroud and an air intake of a centrifugal fan according to another embodiment.
Figure 3B:
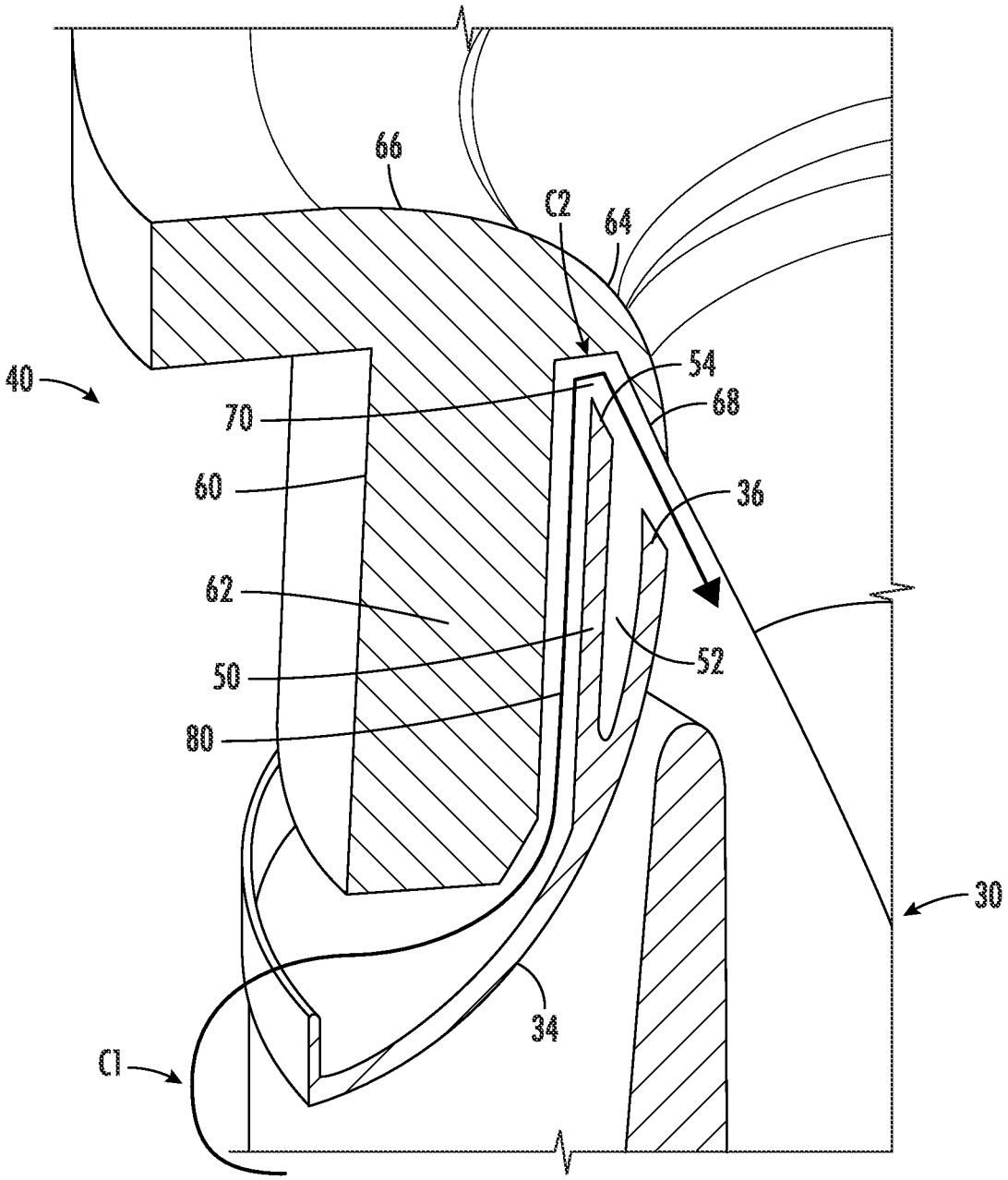
FIG. 3B is a detailed view of the interface between the inlet shroud and the air intake of FIG. 3A according to an embodiment.

With reference now to FIGS. 3A and 3B, the configuration of the inlet shroud 34 and the air intake 40 is substantially identical to those illustrated and described with respect to FIGS. 2A and 2B. As a result, the clearance 80 and fluid flow path defined by the clearance 80 is substantially identical between FIGS. 2A & 2B, and FIGS. 3A and 3B. However, in this embodiment, the distal end 68 of the bell mouth curve 64 is pointed, rather than being rounded. In addition, the overall length of the bell mouth curve 64 is shorter than in the previous embodiment. As shown, the end 68 of the bell mouth curve 64 ends at a location between ends 54, 36 of the flange 50 and the inlet shroud 34, respectively. In the embodiment of FIGS. 2A and 2B, however, the bell mouth curve 64 extended further to a position adjacent the inlet end 36 of the inlet shroud 34.

Figure 4A:
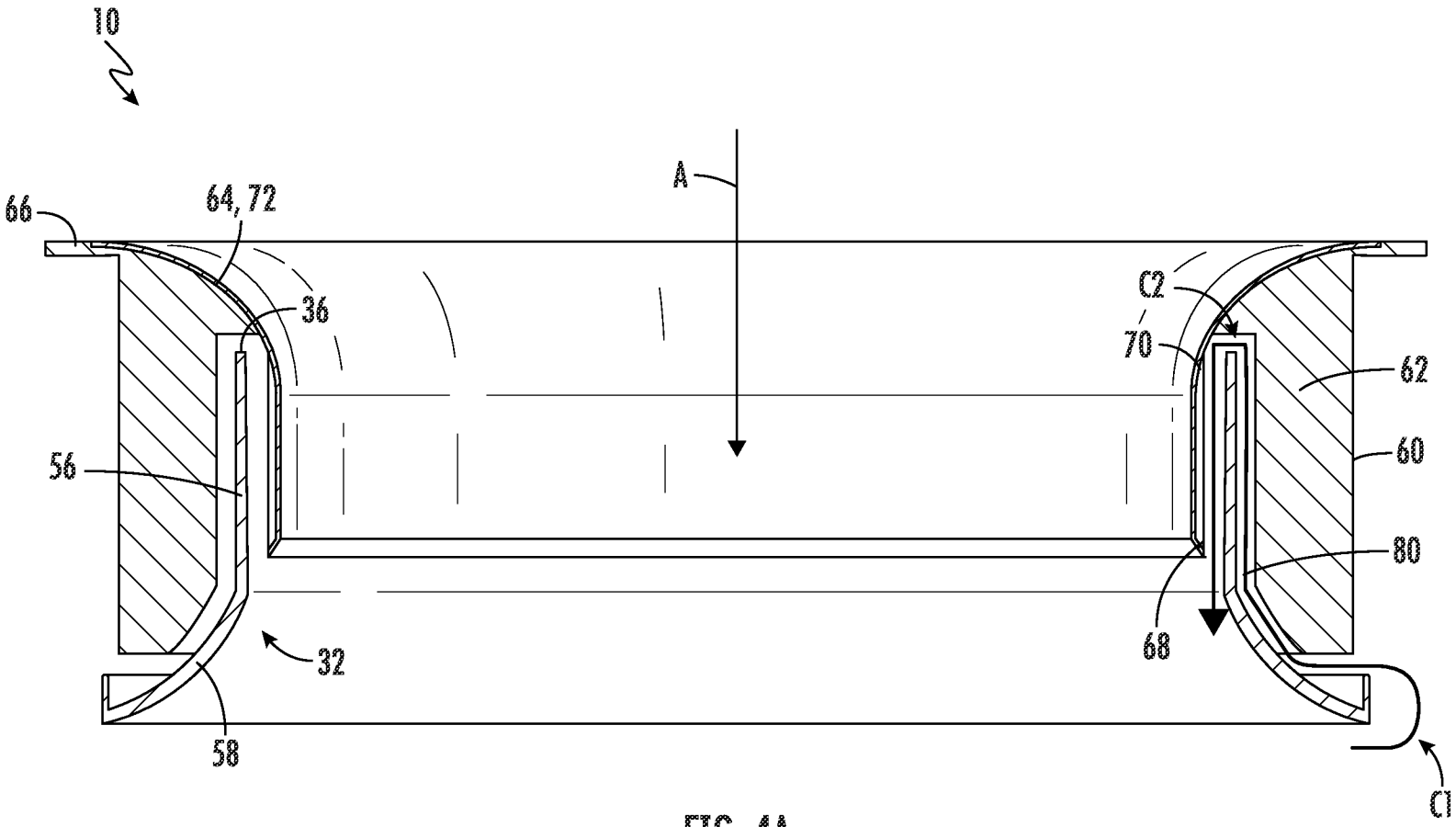
FIG. 4A is a cross-sectional detailed view of an interface between an inlet shroud and an air intake of a centrifugal fan according to another embodiment.
Figure 4B:
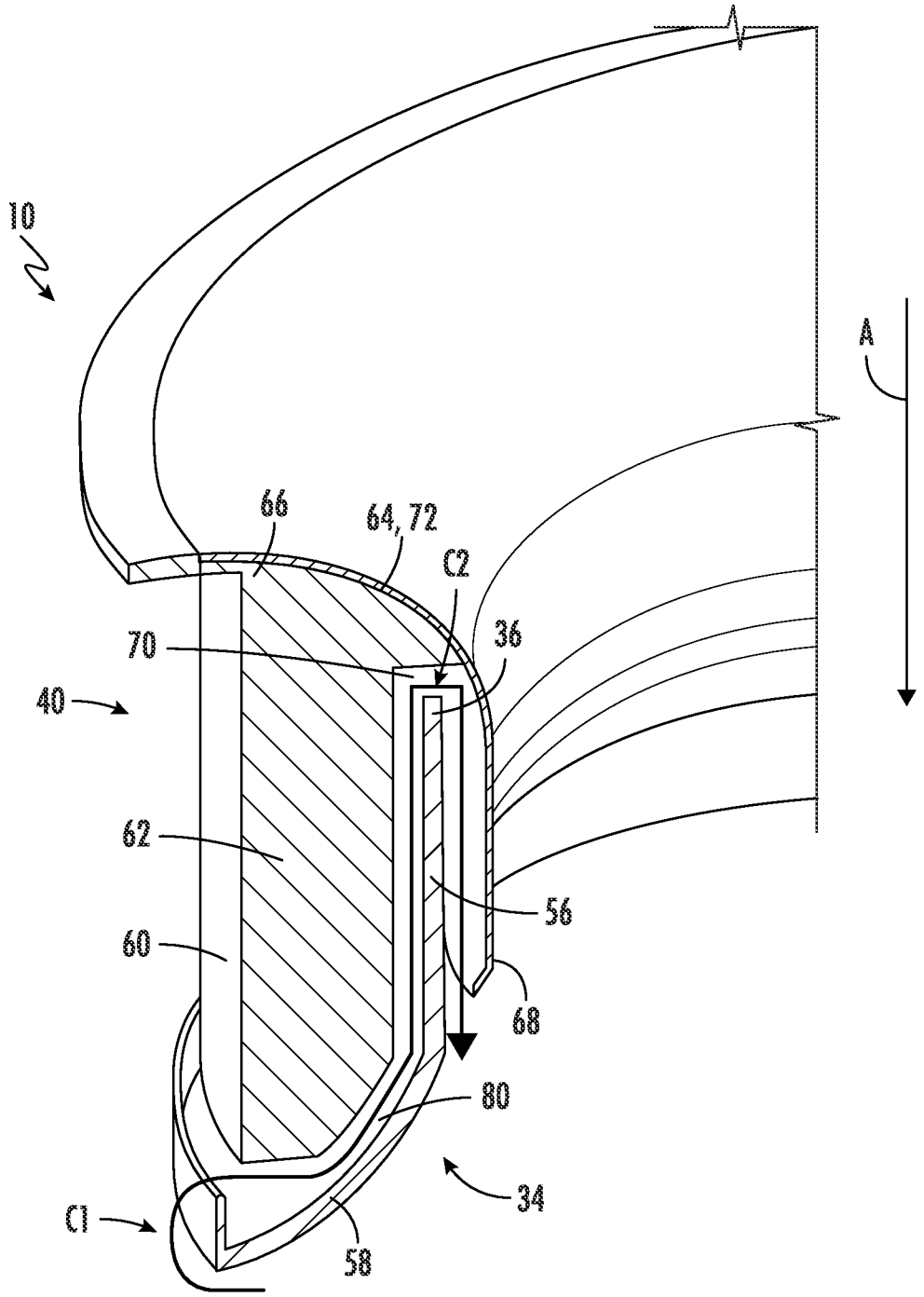
FIG. 4B is a detailed view of the interface between the inlet shroud and the air intake of FIG. 4A according to an embodiment.

In another embodiment, illustrated in FIGS. 4A and 4B, the inlet shroud 34 includes a first portion 56 having a generally axial contour and second portion 58 having an arcuate contour. The first portion 56 of the inlet shroud 34 extends linearly, such as in a vertically oriented axis for example, from the inlet end 36 of the inlet shroud 34. The axial length of the first axial portion 56, measured generally parallel to the axis of rotation X, may be generally equal to, greater than, or alternatively, less than the axial length of the second arcuate portion 58 of the inlet shroud 34. However, in an embodiment, the axial portion 56 of the inlet shroud 34 typically extends vertically below the second end 68 of the air intake 40.

Although the bell mouth contour 64 shown in FIGS. 2-3 is integrally formed with the sidewall 62, in other embodiments, as shown in FIGS. 4A and 4B, the bell mouth contour 64, including the distal end 68 thereof, is formed by a separate component 72 removably or permanently coupled to the sidewall 62. As previously described, the inlet shroud 34 and the air intake 40 cooperate to form a clearance 80 there between. The clearance 80 defines a fluid flow path through which leakage flow may recirculate to the impeller 30. In the illustrated, non-limiting embodiment, the air output radially from the impeller 30 makes a first turn, indicated by arrow C1, to enter the clearance 80 defined between the air intake 40 and the inlet shroud 34. Within the clearance 80, the leakage flow must travel generally parallel to the sidewall 62 of the air intake 40 and the axis of rotation X until reaching distal end 36 of the axial portion 56 of the inlet shroud 34. The leakage flow is configured to make a second turn, indicated by arrow C2, around the distal end 36 of the axial portion 56 and the inlet end 36 of the inlet shroud 34 located within the gap 70. This second turn C2 redirects the leakage flow by at least 90 degrees, and in some embodiments, by 120 degrees, by 150 degrees, up to 180 degrees. In an embodiment, the outlet of the fluid flow path adjacent the downstream end 68 of the bell mouth 64 is oriented generally parallel to the main inlet airflow A.

Figure 5A:
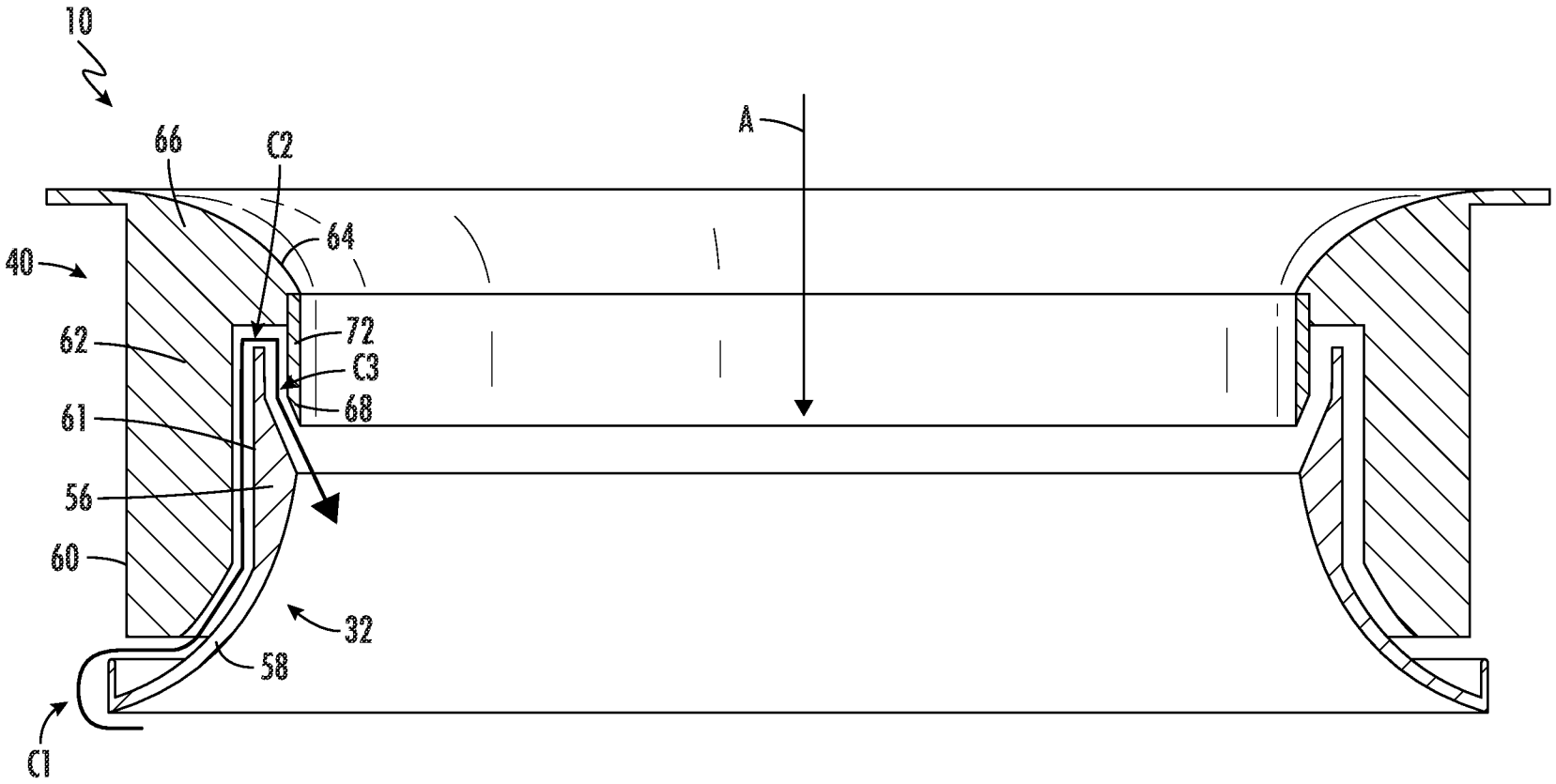
FIG. 5A is a cross-sectional detailed view of an interface between an inlet shroud and an air intake of a centrifugal fan according to another embodiment.
Figure 5B:
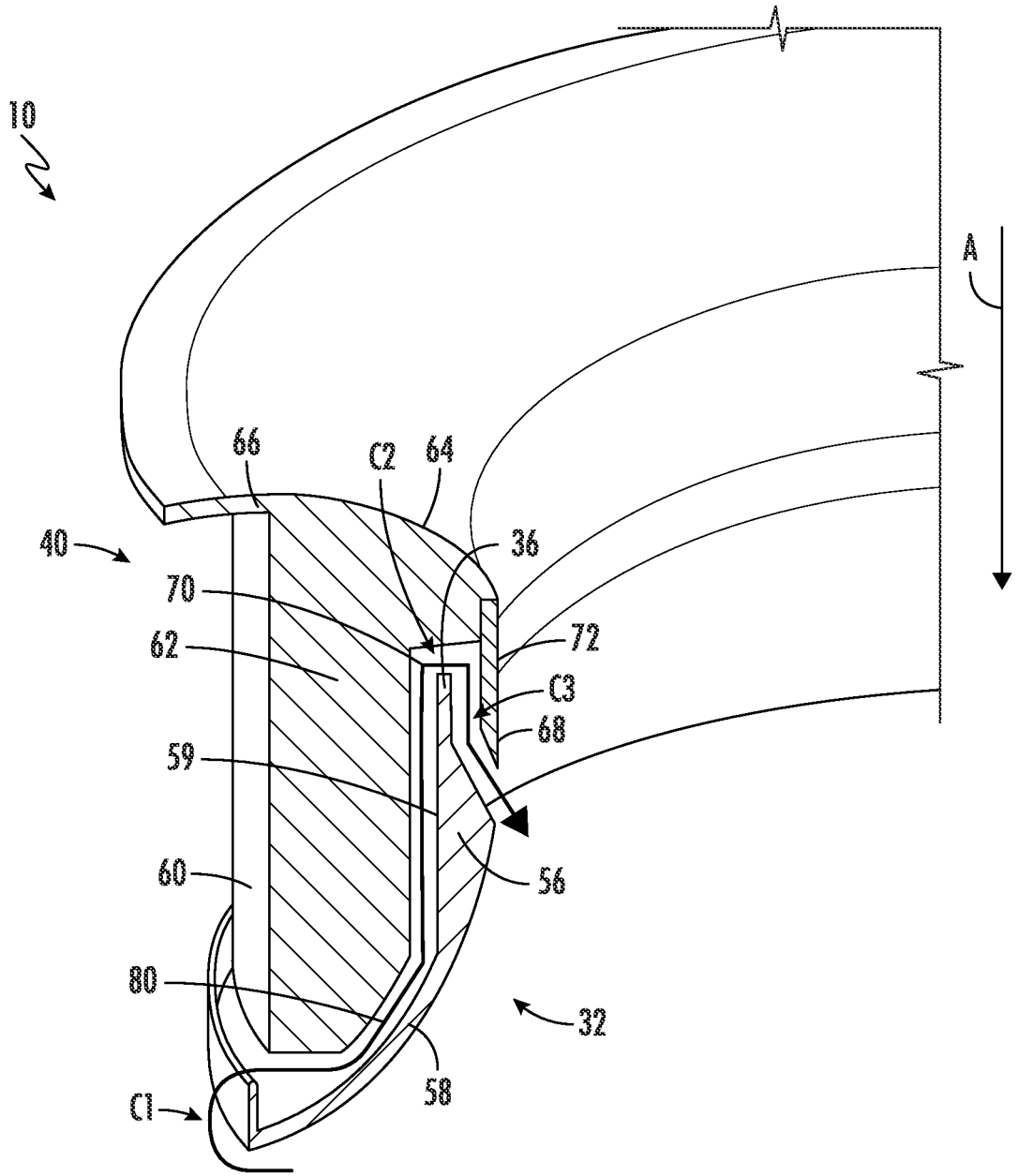
FIG. 5B is a detailed view of the interface between the inlet shroud and the air intake of FIG. 5A according to an embodiment.

With reference now to FIGS. 5A and 5B, the external shape of the inlet shroud 34 is similar to the embodiment of FIGS. 4A and 4B. As shown, the inlet shroud 34 has a first portion 56 having a generally axial contour and second portion 58 having an arcuate contour. Unlike the previous embodiment, a thickness of the axial portion 56 varies over the axial length of the axial portion 56. In an embodiment, the thickness of the axial portion 56 of the inlet shroud 34 gradually increases from adjacent the interface with the second portion 58 towards a center of the axial portion 56. Similarly, the thickness of the axial portion 56 gradually increases from adjacent the inlet end 36 of the inlet shroud 34 towards the center of the axial portion 56. In an embodiment, the resulting thickness variation has a generally triangular-shaped contour. Further, in an embodiment, the exterior surface 59 of the first, axial portion 56 maintains a linear configuration such that the variation in thickness is formed at an interior facing side of the first portion 56 of the inlet shroud 34.

Further, in the illustrated non-limiting embodiment, the separate component 72 of the air intake 40 defines only a portion of the bell mouth contour 64, such as the distal end 68 thereof. As shown, the component 72 extends linearly, such as in a vertically oriented axis for example, parallel to axis X. The component 72 is offset from both the sidewall 62 such that the end 36 of the inlet shroud 34 is receivable within the gap 70 defined between the component 72 and the sidewall 62. The fluid flow path defined by the clearance 80 formed between the air intake 40 and the inlet shroud 34 is similar to that taught in the embodiment of FIGS. 4A and 4B. However, in addition to the turns C1 and C2 previously disclosed, the fluid flow path makes an additional turn, illustrated by arrow C3, resulting from the thickness variation in the first axial portion 56 of the inlet shroud 34. In an embodiment, the turn C3 redirects the leakage flow by at least 30 degrees, and in some embodiments, by 45 degrees, or by up to 60 degrees, such that the outlet of the fluid flow path adjacent the downstream end 68 of the bell mouth 64 is oriented generally parallel to the main inlet airflow A.

It should be understood that each of the configurations of the inlet shroud 34 and air intake 40 illustrated and described herein are intended as an example only, and it should be understood that other suitable configurations are also within the scope of the disclosure. In any suitable configuration, the contour of the gap 80 may be generally complementary in size and shape to a portion of the inlet shroud 34 receivable therein.

By lengthening and complicating the fluid flow path defined between the clearance 80 between the air intake 40 and the inlet shroud 34 of the impeller 30, the amount of leakage flow returned to the impeller 30 is reduced. Further, by orienting the leakage flow generally parallel to the rotational axis X as it reenters the impeller 30, the remaining leakage flow will deviate as little as possible the main flow toward the axis, preventing an inhomogeneous velocity profile at the inlet section of the impeller 30. The improvement in efficiency achieved by reducing the leakage flow and directing the leakage flow within the impeller 30 will result in a lower noise level of the fan 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An interface of a centrifugal fan, comprising:

an inlet shroud of an impeller;

a flange extending from a central portion of an exterior surface of the inlet shroud, wherein a free end of the flange and an adjacent end of the inlet shroud are angled towards a central axis about which the impeller rotates:

an air intake positioned in overlapping arrangement with a portion of the inlet shroud; and a clearance defined between the inlet shroud and the air intake, wherein the clearance forms a labyrinth fluid flowpath for a leakage air flow.

2. The interface of claim 1, wherein the labyrinth fluid flow path has a non-linear configuration.

3. The interface of claim 1, wherein the clearance that forms the labyrinth fluid flow path has at least one turn formed therein.

4. The interface of claim 3, wherein the at least one turn includes at least a 90 degree turn.

5. The interface of claim 3, wherein the at least one turn is at least a 120 degree turn.

6. The interface of claim 5, wherein the air intake includes an axisymmetric body defined by the sidewall.

7. The interface of any of claim 3, wherein the at least one turn is about a 180 degree turn.

8. The interface of claim 1, wherein the air intake has a gap formed therein, and a portion of the inlet shroud is positioned within the gap such that the air intake and the inlet shroud axial overlap.

9. The interface of claim 8, wherein the gap is located between a sidewall of the air intake and a portion of a bell mouth curve of the suction intake.

10. The interface of any of claim 1, wherein the inlet shroud includes a first portion and a second portion, the first portion having an axial configuration and the second portion having an arcuate configuration.

11. A fan for use in an air conditioning device comprising:

a centrifugal impeller configured to rotate about an axis of rotation, the impeller having:

a plurality of blades; and an inlet shroud mounted at a distal end to the plurality of blades, the inlet shroud further comprising a flange extending from a central portion of an exterior surface of the inlet shroud, wherein a free end of the flange and an adjacent end of the inlet shroud are angled towards the axis of rotation; and an air intake positioned upstream from the impeller relative to a main airflow such that the air intake and the inlet shroud axially overlap, the air intake being contoured to direct the main airflow towards the impeller; and a fluid flow path defined between the impeller and the air intake suction intake, wherein the fluid flow path forms a labyrinth seal.

12. The fan of claim 11, wherein the fluid flow path has a non-linear configuration.

13. The fan of claim 11 wherein the fluid flow path has at least one turn formed therein.

14. The fan of claim 13, wherein the fluid flow path includes at least one about 180 degree turn.

15. The fan of any of claim 11, wherein the air intake has a gap formed therein, and a portion of the inlet shroud is positioned within the gap.

16. The fan of any of claim 15, wherein the air intake further comprises a sidewall and a bell mouth curve, the gap being defined between the sidewall and a portion of the bell mouth curve.

* * * * *